United States Patent [19]

Amsler

[11] 4,021,629

[45] May 3, 1977

[54] ARC ELECTRODE, ESPECIALLY FOR A CONTACT ARRANGEMENT IN A VACUUM SWITCH

[75] Inventor: Joachim Amsler, Seon, Switzerland

[73] Assignee: Sprecher & Schuh AG, Aarau, Switzerland

[22] Filed: June 25, 1975

[21] Appl. No.: 590,282

[30] Foreign Application Priority Data

Sept. 5, 1974 Switzerland ..... 12074/74

[52] U.S. Cl. ..... 200/144 B
[51] Int. Cl.[2] ..... H01H 33/66
[58] Field of Search ..... 200/144 B

[56] References Cited

UNITED STATES PATENTS

| | | | |
|---|---|---|---|
| 3,773,993 | 11/1973 | Amsler | 200/144 B |
| 3,866,005 | 2/1975 | Amsler | 200/144 B |
| 3,869,589 | 3/1975 | Hundstad | 200/144 B |

*Primary Examiner*—Robert S. Macon

[57] ABSTRACT

An arc electrode, especially for a contact arrangement in a vacuum switch, comprising an essentially hollow cylindrical contact component and electrode elements fixedly connected with the essentially hollow cylindrical contact component and extending into the interior of such contact component, said electrode elements serving for taking-up the base points of the arc. The electrode elements are arranged to extend over the entire axial length of the contact component.

7 Claims, 6 Drawing Figures

ARC ELECTRODE, ESPECIALLY FOR A CONTACT ARRANGEMENT IN A VACUUM SWITCH

BACKGROUND OF THE INVENTION

The present invention relates to a new and improved construction of arc electrode, especially for a contact arrangement employed in a vacuum switch, comprising an essentially hollow cylindrical contact component and electrode elements fixedly connected therewith and protruding into the interior of the contact component, said electrode elements serving to take-up the arc base points.

Such type arc electrode has been disclosed in U.S. Pat. No. 3,866,055, Feb. 11, 1975, corresponding to Swiss Pat. No. 531,784, and the disclosures of which are incorporated herein by reference. Upon opening a vacuum switch equipped with such arc electrodes there initially prevails an arc between the contact surfaces of the contact components, which arc, under the action of the self-magnetic field, commutates from the contact surfaces to the narrow surfaces of the electrode elements and at that location burns in a diffuse manner until extinguishing the arc.

Notwithstanding the fact that in the case of arcs which burn in a diffuse manner the contact burn-off is less than in the case of a column arc, still there are nonetheless formed metallic vapors which do not condense to a sufficient degree in the space formed by the contact component and located behind the electrode elements, and therefore, such vapors at least partially can migrate back into the separation gap or path. Even relatively small amounts of metallic vapors in the separation gap can lead to re-ignition of the arc, thereby appreciably impairing the operational reliability of the switch.

In order to cool and condense such metallic vapors it has already been proposed to arrange in this space or compartment behind the electrode elements a condenser consisting of metallic chips or shavings or sheet metal members.

Such devices however are not adequate in the case of arc electrodes for vacuum switches operating at high cut-off or interruption currents, and additionally, they are complicated and expensive to fabricate.

SUMMARY OF THE INVENTION

Hence, it is a primary object of the present invention to provide an improved construction of arc electrode, especially for a contact arrangement of a vacuum switch, which is not associated with the aforementioned drawbacks and limitations of the prior art proposals.

Another and more specific object of this invention aims at economically constructing an arc electrode of the previously mentioned type in a manner such that even at high cut-off currents no metallic vapors arrive at the separation gap or path and therefore, there is reliably eliminated any possibility of undersirable re-ignition of the arc possibly brought about by such metallic vapors arriving in the separation gap.

Now in order to implement these and still further objects of the invention, which will become more readily apparent as the description proceeds, the arc electrode of this development, particularly for the contact arrangement of a vacuum switch, is manifested by the features that the electrode elements are arranged to extend over the entire axial length of the contact component.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
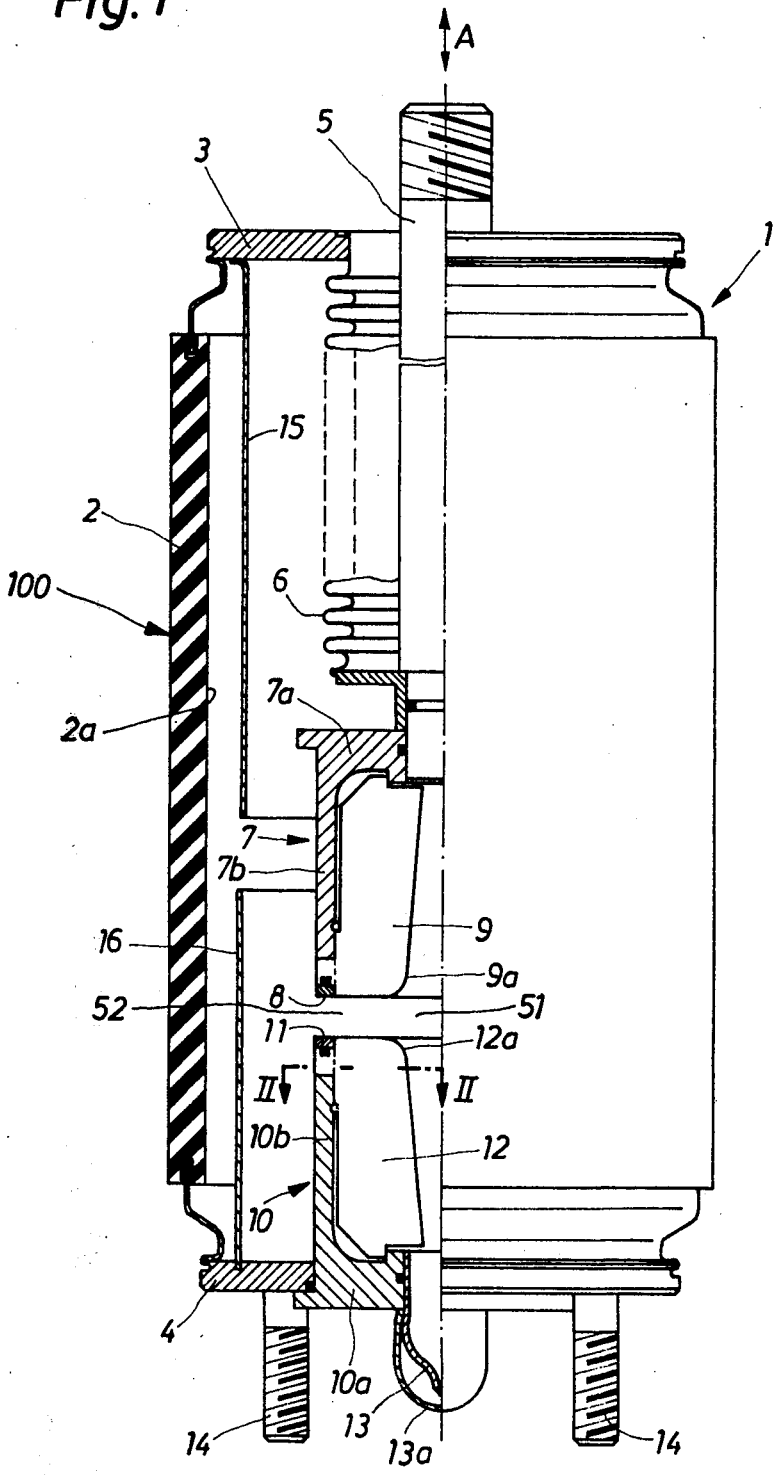
FIG. 1 illustrates in elevational view, partially in longitudinal sectional view, a vacuum switch designed according to the teachings of the present invention.

Describing now the drawings, according to the exemplary embodiment of vacuum switch 100 depicted in FIG. 1 the same embodies a vacuum-tight housing 1 possessing a substantially cylindrical jacket or shell 2 formed of electrically insulating material and at which there is secured at the top and bottom a respective metallic cover or cover member 3 and 4. Guided through the upper metallic cover 3 is a movable switching element 5 which is attached by means of a metallic bellows 6 at such cover 3. The switching element 5 carries at its lower end a substantially hollow cylindrical contact component or element 7 composed of a floor or base portion **7*a* and a side wall portion 7*b*. The side wall portion 7*b* forms a substantially ring-shaped or annular contact surface 8. At the inside of the side wall portion 7*b* there are arranged radially extending sheet metal or plate electrodes 9**, the function of which will be more fully described hereinafter.

The switching element 5 together with the contact element or component 7 is shown in its current cut-off position and can be moved to-and-fro in the direction of the double-headed arrow A by means of any suitable and therefore not particularly illustrated actuation mechanism as is well known in this art.

Fixedly connected with the lower metallic cover or cover member 4 is a substantially hollow cylindrical contact element or component 10 having a floor or base portion **10*a* and a side wall portion 10*b*. The construction of this contact element or component 10 essentially corresponds to that of the contact element or component 7. The side wall portion 10*b* forms a substantially ring-shaped or annular contact surface 11 which, when the switch 100 is closed, comes to bear against the contact surface 8. At the inside of the side wall portion 10*b* there are likewise mounted sheet metal or plate electrodes 12 which correspond to the sheet metal electrodes 9**.

Mounted at the floor or base portion **10*a* is a pipe or tubular member 13 by means of which the housing can be suitably evacuated and following evacuation can be closed by appropriately clamping-off or pinching-off the same. The pinch-off location is protected against mechanical damage by a hood 13*a* or the like. Screws 14 or equivalent structure are mounted at the cover 4** and serve for the attachment or mounting of the switch and the current terminals.

Between the contact components 7 and 10 the jacket or shell 2 there are arranged two substantially tubular-shaped metallic shields 15 and 16, each of which are secured in any suitable manner at the covers 3 and 4 respectively, and in spaced relationship from one another. These tubular metallic shields or plates 15 and 16 prevent condensation of any arising metallic vapors at the inner surface 2*a* of the jacket or shell 2. The sheet metal electrodes 9 and 12 of both identical contact components 7 and 10 extend up to the associated floor portions 7*a* and 10*a*, respectively, over the entire height of the contact components 7, 10. As best seen by referring to FIG. 2 gaps or spaces 50 are left free between the individual neighboring sheet metal electrodes 9 and 12.

These sheet metal electrodes 9 and 12 each possess a narrow surface 9*a* and 12*a*, respectively, which initially extends essentially parallel to the plane of the contact surfaces 8 and 11, respectively, and then thereafter extends to the associated floor portions 7*a* and 10*a*, respectively. These narrow surfaces 9*a* and 12*a* form boundary surfaces which delimit or bound a space or compartment 51 for the arc.

Upon opening of the vacuum switch 100 depicted in FIG. 1 there is formed an arc between the contact surfaces 8 and 11 which, under the action of the self-magnetic field, commutates to the narrow surfaces 9*a* and 12*a* of the sheet metal electrodes 9 and 12 respectively, where it burns diffusely until it is extinguished. The hot metallic vapors which flow through the gaps 50 between the sheet metal electrodes 9 and 12 are cooled and condensed at the surfaces of such sheet metal electrodes, so that they can not move back into the separation gap or path 52.

The described switch is designed to handle higher cut-off or interruption currents than the previously mentioned state-of-the-art vacuum switch. However, it has been found that by increasing the diameter of the contact component, or by proportionally increasing the size of the switch it is not possible to realize any further increase of the current to be cut-off or interrupted. In the case of higher currents the arc plasma column tends to constrict, the so-called pinch effect. The axial pressure becomes greater in the plasma, so that there occurs a more pronounced axial plasma flow.

Yet in order to be able to obtain switches for still higher cut-off currents, the contact components and the electrode elements are advantageously constructed in the manner schematically depicted in FIGS. 3 to 6.

The substantially hollow cylindrical contact components 17 shown in these Figures correspond to the contact components 7 and 10 illustrated in FIG. 1 and like such possess a floor portion 17*a* and a side wall portion 17*b* with the contact surface 18.

Figure 2:
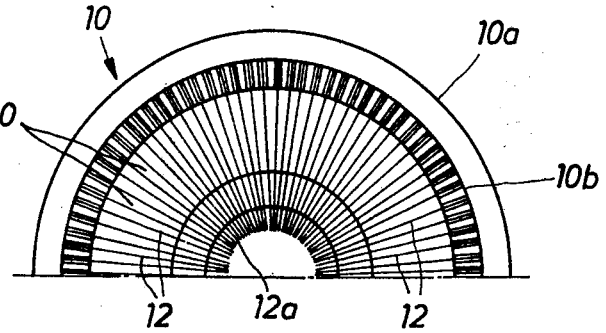
FIG. 2 is a cross-sectional view taken along the line II—II of FIG. 1.

Generally speaking, in contrast to the exemplary embodiment according to FIGS. 1 and 2, with the exemplary embodiments according to FIGS. 3 to 6 the electrodes are subdivided into individual elements in the direction of the axis of the formed arc, i.e. in the axial direction of the contact element or component 17, and which individual elements are separated from one another by an intermediate space.

Figure 3:
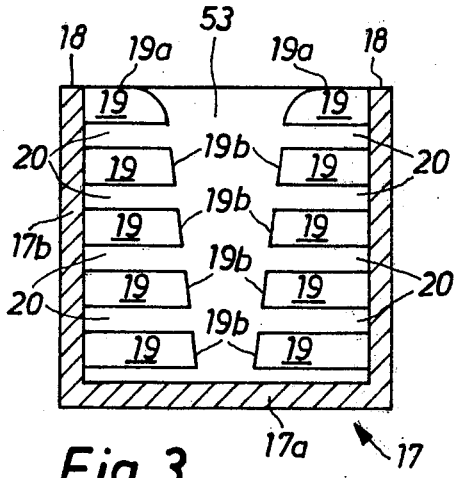
FIGS. 3, 4, 5, and 6 schematically illustrate different exemplary embodiments of arc electrodes as contemplated by the invention.

With the exemplary embodiment depicted in FIG. 3 there are provided radially extending electrode elements 19 which are arranged in the axial direction of the contact component 17 above one another with an intermediate space 20 between each two neighboring electrode elements. The electrode elements 19, analogous to the construction of FIG. 2, are distributively arranged over the entire inner surface of the side wall portion 17*b*. These electrode elements 19 are arranged in substantially parallel planes which are disposed at right angles to the lengthwise of the contact component, and the same relationships exist for the other embodiments to be discussed hereinafter. The narrow side 19*a* of each uppermost situated electrode element 19 extends initially essentially parallel to the plane of the contact surface 18 and thereafter in the direction of the floor portion 17*a*, so that it together with the narrow sides 19*b*, of the electrode elements 19 located therebelow defines a boundary surface. This boundary surface of all superimposed arranged electrode elements 19, analogous to the construction of FIGS. 1 and 2, defines a space or compartment 53 for the arc.

Figure 4:
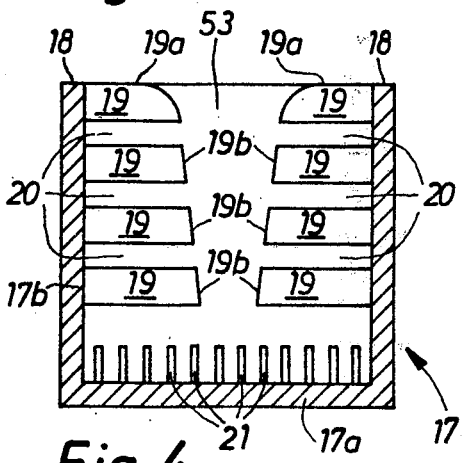

The exemplary embodiment depicted in FIG. 4 corresponds to that discussed above with respect to FIG. 3, with the exception that instead of the lowermost electrode elements 19 neighboring the floor portion 17*a* being constructed as above-discussed, here there are provided substantialy pin-shaped electrode elements 21 mounted in spaced relationship from one another at the inside of the floor portion 17*a* and extending away therefrom.

Figure 5:
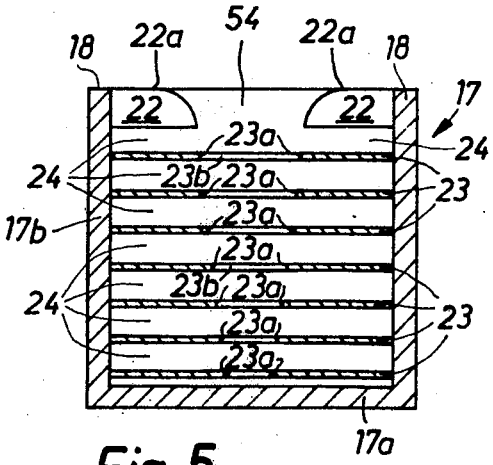

With the exemplary embodiment shown in FIG. 5 there are arranged radially extending electrode elements 22 at the end of the contact component 17 which possesses the contact surface 18, these radial or radially extending electrode elements 22 being arranged in spaced relationship from one another at the inner periphery of the side wall portion 17*b*. These electrode elements 22 correspond to the uppermost electrode elements 19 of the arrangement of FIGS. 3 and 4 just as was the case for such electrode elements each possess a narrow surface 22*a* which extends essentially parallel to the plane of the contact surface 18 and at the end thereof extend towards the floor portion 17*a*.

Beneath these electrode elements 22 there are arranged perforated or apertured discs 23 which are disposed essentially parallel to one another, wherein between the spaced perforated discs 23 themselves and the uppermost perforated disc 23 and the electrode elements 22 there is present a respective intermediate space or compartment 24.

The diameter of the round holes or bores 23*b* of the perforated discs 23 decreases in the direction of the floor portion 17*a*, so that the edges 23*a* of the perforated discs 23 which bound such holes or bores 23*b* together with the narrow surfaces 22*a* of the electrode elements 22, analogous to the arrangement of FIGS. 3 and 4, determine boundary surfaces which in totality delimit or bound the space 54 for the arc.

Figure 6:
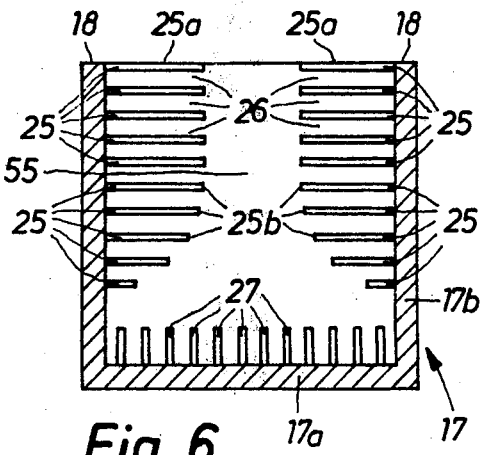

With the exemplary embodiment illustrated in FIG. 6 radial pin electrodes 25 are arranged at a mutual spacing from one another in individual planes which are essentially in parallellism with one another.

Between the superimposed arranged pin electrodes 22 there are provided intermediate spaces or compartments 26. The uppermost pin electrodes 25 possess a narrow surface 25*a* which extends essentially parallel to the plane of the contact surface 18.

The end surfaces or ends 25*b* of the superimposed pin electrodes 25 define boundary surfaces which in their totality delimit a space or compartment 55 for the arc. At the floor portion 17*a* there are attached pin members or pins 27 which protrude away from the inside of such floor portion 17*a* and are arranged at a mutual spacing from one another.

By virtue of the arrangement of the electrode elements which have been described in conjunction with FIGS. 3 to 6 inclusive, there is achieved the result that between electrode elements which neighbor one another in axial direction and are separated from one another by an intermediate space or compartment there arise potential differences and the current-conducting arc base points are thus drawn to the electrode element which in each case is located therebelow, so that the arc is attenuated or stretched. Consequently, there is favored extinguishing of the arc and cooling of the plasma column even at high cut-off or interruption currents.

What is strived for is a voltage drop between neighboring electrode elements which is greater than the voltage drop in the plasma column.

The contact components 7, 10 and 17 consist of copper, however could also contain small amounts of additional elements such as, for instance, bismuth, beryllium, lead or tin, in order to prevent welding of the contact surfaces 8, 11 and 18 bearing against or contacting one another when conducting higher currents.

The electrode elements 9, 12, 19, 21, 22, 23, 25 and 27 preferably consist of iron, however could be formed, for instance, also of nickel, chromium, chromium-nickel, molybdenum, tantalum or tungsten.

In order to prevent an impairment of the vacuum in the housing 1 of the vacuum switch 100 by outflowing gas molecules, the electrode elements can be coated with a suitable getter material, such as a layer containing, for instance, zirconium-aluminium or zirconium-titanium.

Due to the arrangement of the getter material at the electrode elements there is not required any special heating device for the requisite heating of the getter material, since the arc to be interrupted heats the electrode elements and thus the getter material.

In all of the exemplary embodiments the layer, which is located beneath the narrow surfaces of the electrode elements defining the boundary surfaces, is gas pervious, and the electrodes with a thickness of such layer of 1 centimeter possess free surfaces between 2 and 50 $cm^2$ per 1 $cm^3$ volume. Additionally, the space factor of the material of the electrode elements in this 1 centimeter thick layer at most amounts to 75 percent by volume. Finally, it is to be mentioned that in the embodiments herein disclosed by way of example the radial length of the electrode elements is generally smaller than the inner radius of the associated contact component.

While there is shown and described present preferred embodiments of the invention, it is to be distinctly understood that the invention is not limited thereto, but may be otherwise variously embodied and practiced within the scope of the following claims.

What is claimed is:

1. An arc electrode, especially for a contact arrangement of a vacuum switch, comprising an essentially hollow cylindrical contact piece having a longitudinal axis, and a plurality of electrode elements for taking-up arc base points, said electrode elements being fixedly connected with said essentially hollow cylindrical contact piece, extending into the interior of said contact piece along a radial direction, and being mutually spaced from one another along the longitudinal axis of said contact piece.

2. An arc electrode as defined in claim 1, wherein said electrode elements are arranged in substantially parallel planes disposed at right angles to the longitudinal axis of said contact piece.

3. An arc electrode as defined in claim 2, wherein said electrode elements are at least partially formed of sheet metal.

4. An arc electrode as defined in claim 12, wherein said electrode elements are at least partially formed of perforated discs.

5. An arc electrode as defined in claim 2, wherein said electrode elements are at least partially formed of pin electrodes.

6. An arc electrode as defined in claim 2, wherein said contact piece includes a floor portion, a plurality of pin electrodes secured to said floor portion and extending away therefrom, said pin electrodes being mutually spaced from one another.

7. An arc electrode as defined in claim 1, wherein said electrode elements are coated with a layer of a getter material.

* * * * *